US005095171A

United States Patent [19]

Feimer et al.

[11] Patent Number: 5,095,171

[45] Date of Patent: Mar. 10, 1992

[54] CONTROL OF OXYGEN LEVEL IN FEED FOR IMPROVED AROMATICS/NON-AROMATICS PERVAPORATION (OP-3602)

[75] Inventors: Joseph L. Feimer, Bright's Grove, Canada; Tan J. Chen, Baton Rouge, La.

[73] Assignee: Exxon Research and Engineering Company, Florham Park, N.J.

[21] Appl. No.: 681,274

[22] Filed: Apr. 8, 1991

[51] Int. Cl.[5] ..... C07C 7/144; C07C 7/00

[52] U.S. Cl. ..... 585/819; 585/804; 585/860; 585/864; 208/308; 210/639; 210/640

[58] Field of Search ..... 585/819, 804, 860, 864; 208/308; 210/639, 640

[56] References Cited

U.S. PATENT DOCUMENTS

| | | | |
|---|---|---|---|
| 2,930,754 | 3/1960 | Stuckey | 210/23 |
| 2,947,687 | 8/1960 | Lee | 210/23 |
| 2,958,656 | 11/1960 | Stuckey | 210/23 |
| 3,140,256 | 7/1964 | Martin et al. | 210/23 |
| 3,370,102 | 2/1968 | Carpenter et al. | 260/674 |
| 4,115,465 | 9/1978 | Elfert et al. | 260/674 |
| 4,837,054 | 6/1989 | Schucker | 427/244 |
| 4,861,628 | 8/1989 | Schucker | 427/245 |
| 4,879,044 | 11/1989 | Feimer et al. | 210/654 |
| 4,914,064 | 4/1990 | Schucker | 502/4 |
| 4,929,357 | 5/1990 | Schucker | 210/640 |
| 4,929,358 | 5/1990 | Koenitzer | 210/640 |
| 4,944,880 | 7/1990 | Ho et al. | 210/640 |
| 4,946,594 | 8/1990 | Thaler et al. | 210/651 |
| 4,962,271 | 10/1990 | Black et al. | 585/819 |
| 4,990,275 | 2/1991 | Ho et al. | 252/62.3 |

*Primary Examiner*—Anthony McFarlane
*Assistant Examiner*—Nhat Phan
*Attorney, Agent, or Firm*—Joseph J. Allocca

[57] ABSTRACT

The separation of aromatic hydrocarbons from mixtures of aromatic and non-aromatic hydrocarbon feeds under pervaporation conditions, is improved by the control of the amount of oxygen present in the feed. The amount of oxygen in the feed, such as heavy cat naphtha or other cracked feed, should be less than 30 wppm, preferably less than 10 wppm. The oxygen level in the feed can be controlled by the addition of small amount of oxygen scavenger into the feed. Hindered phenols are representative of useful oxygen scavengers.

18 Claims, 5 Drawing Sheets

(1) AIR BUBBLED INTO FEED BETWEEN 2-4 HOURS OF OPERATIONS (I) AIR BUBBLED INTO FEED BETWEEN 2-4 HOURS OF OPERATIONS

CONTROL OF OXYGEN LEVEL IN FEED FOR IMPROVED AROMATICS/NON-AROMATICS PERVAPORATION (OP-3602)

BACKGROUND OF THE INVENTION

1. Field of the Invention

The present invention is a process whereby separation of aromatic hydrocarbons from aromatic and non-aromatic hydrocarbon feeds by pervaporation through selective membranes is improved by control of the amount of oxygen present in the feed. Maintenance of the feed oxygen concentration below 50 wppm, preferably below about 30 wppm, more preferably below 10 wppm, most preferably about 1 wppm and less, permits flux maintenance over the course of the pervaporation process. Oxygen levels in the feed can be maintained in or reduced to the recited low concentration ranges by use of oxygen scavengers or inhibitors such as hindered phenols or hindered amines.

Maintaining feed oxygen content levels at a low level has been found to be effective in preventing loss of flux during the course of the pervaporative separation of aromatic hydrocarbons from aromatic and non-aromatic feed mixtures. These feed mixtures are typically cracked hydrocarbon feeds exemplified by light cat naphtha, intermediate cat naphtha, heavy cat naphtha, jet fuel, diesel and coker gas oil, feed stocks which range from 65° to 1050° F. in boiling point.

2. Description of the Related Art

The removal of aromatic hydrocarbons from feed streams containing mixtures of aromatic hydrocarbons and non-aromatic hydrocarbons using membranes is a desirable process which has been described in the patent literature.

U.S. Pat. No. 2,947,687 teaches the separation of hydrocarbons by type through a non-porous membrane using a membrane solvent to enhance the permeation rate. Membrane solvents include substituted hydrocarbons which are soluble in and have solvent power for the membrane. The hydrocarbon solvent is an organic compound containing one or more atoms of halogen, oxygen, sulfur or nitrogen. Thus, materials such as carbontetrachloride, alcohols, ketones, esters, ethers, carboxylic acids, mercaptans, sulfides (e.g., diethylsulfide etc.), nitropropane, nitrobenzene, acetonitrile, formamide, ethylene diamine, etc. may be employed in an amount ranging from 1 to 100% based on total solvent to hydrocarbon feed. The process may be operated at a pressure differential between the feed and permeate zone with the permeate being removed by vacuum. Alternately the permeate can be removed by a sweep stream such as steam, air, butane, etc.

The membrane is non-porous and includes natural or synthetic rubber, vinyl polymers, cellulose esters, cellulose ethers.

The process can use any hydrocarbon source as feed and the separation achieved is in the order: saturated hydrocarbons, <unsaturated hydrocarbons, <aromatics. Saturated hydrocarbons of approximately the same boiling range permeate in the order of increasing selectivity: branched chain, <cyclic-chain, <straight chain configuration, i.e., straight chain paraffins more readily permeate through the membrane.

U.S. Pat. No. 3,140,256 teaches a membrane separation process employing a membrane comprised of a cellulose derivative (e.g. cellulose ester or ether) modified by reaction with aldehydes, organic di isocyanate, organic monoisocyanate, organo-phosphorus chlorides and organo-sulfur chlorides. Hydrocarbon feeds can be separated into these components by type using the membrane, e.g. aromatics can be separated from unsaturated hydrocarbon (olefins or di olefins) and/or from paraffins, or branched chain aliphatic hydrocarbons can be separated from other aliphatic hydrocarbons which have a different number of branched chains. Aromatic hydrocarbons permeate more rapidly than do the saturated (i.e. paraffinic) hydrocarbons. In an example methyl cyclohexane permeated through the membrane more selectively than did iso octane.

U.S. Pat. No. 3,370,102 teaches the membrane separation of aromatics from saturates in a wide variety of feed mixtures including various petroleum fractions, naphthas, oils, and other hydrocarbon mixtures. Expressly recited in '102 is the separation of aromatics from kerosene. The process produces a permeate stream and a retentate stream and employs a sweep liquid to remove the permeate from the face of the membrane to thereby maintain the concentration gradient driving force. U.S. Pat. No. 2,958,656 teaches the separation of hydrocarbons by type i.e. aromatics, unsaturated, saturated by permeating a portion of the mixture through a non-porous cellulose ether membrane and removing permeate from the permeate side of the membrane using a sweep gas or liquid. U.S. Pat. No. 2,930,754 teaches a method for separating hydrocarbons by type, i.e. aromatics and/or olefins from gasoline boiling range mixtures by the selective permeation of the aromatics through certain cellulose ester non-porous membranes. The permeated hydrocarbons are continuously removed from the permeate zone using a sweep gas or liquid. U.S. Pat. No. 4,115,465 teaches the use of polyurethane membranes to selectively separate aromatics from saturates via pervaporation.

Polyurea/urethane membranes and their use for the separation of aromatics from non-aromatics are the subject of U.S. Pat. No. 4,914,064. In that case the polyurea/urethane membrane is made from a polyurea-/urethane polymer characterized by possessing a urea index of at least about 20% but less than 100%, an aromatic carbon content of at least about 15 mole percent, a functional group density of at least about 10 per 1000 grams of polymer, and a C=O/NH ratio of less than about 8.0. The polyurea/urethane multi-block copolymer is produced by reacting dihydroxy or polyhydroxy compounds, such as polyethers or polyesters having molecular weights in the range of about 500 to 5,000 with aliphatic, alkylaromatic or aromatic diisocyanates to produce a prepolymer which is then chain extended using diamines, polyamines or amino alcohols. The membranes are used to separate aromatics from non-aromatics under perstraction or pervaporation conditions.

Thin film composites can be prepared either from suspension deposition as taught in U.S. Pat. No. 4,861,628 or from solution deposition as taught in U.S. Pat. No. 4,837,054.

The use of polyurethane imide membranes for aromatics from non-aromatics separations is disclosed in U.S. Pat. No. 4,929,358. The polyurethane-imide membrane is made from a polyurethane-imide copolymer produced by end capping a polyol such as a dihydroxy or polyhydroxy compound (e.g. polyether or polyester) with a di or polyisocyanate to produce a prepolymer which is then chain extended by reaction of said prepolymer with a di or polyanhydride or with a di or polycarboxylic acid to produce a polyurethane/imide. The aromatic/non-aromatic separation using said membrane is preferably conducted under perstraction or pervaporation conditions.

A polyester imide copolymer membrane and its use for the separation of aromatics from non-aromatics is the subject of U.S. Pat. No. 4,946,594. In that case the polyester imide is prepared by reacting polyester diol or polyol with a dianhydride to produce a prepolymer which is then chain extended preferably with a diisocyanate to produce the polyester imide.

U.S. Pat. No. 4,929,357 is directed to non-porous isocyanurate crosslinked polyurethane membranes. The membrane can be in the form of a symmetric dense film membrane. Alternatively, a thin, dense layer of isocyanurate crosslinked polyurethane can be deposited on a porous backing layer to produce a thin film composite membrane. The isocyanurate crosslinked polyurethane membrane can be used to separate aromatic hydrocarbons from feed streams containing mixtures of aromatic hydrocarbons and non-aromatic hydrocarbons, the separation process being conducted under reverse osmosis, dialysis, perstraction or pervaporation conditions, preferably under perstraction or pervaporation conditions.

U.S. Ser. No. 452,887, filed Dec. 19, 1989 in the names of Black and Schucker, now U.S. Pat. No. 4,962,271 teaches the selective separation of multi-ring aromatic hydrocarbons from distillates by perstraction. The multi-ring aromatics are characterized by having less than 75 mole % aromatic carbon content. Perstractive separation is through any selective membrane, preferably the aforesaid polyurea/urethane, polyurethane imides or polyurethane isocyanurates.

SUMMARY OF THE INVENTION

The present invention is a process whereby the flux in a pervaporation separation process which separates aromatics from non-aromatics in hydrocarbon feeds comprising mixtures of same is maintained by controlling the oxygen content of the feed. Maintenance of the feed oxygen concentration below 50 wppm, preferably below about 30 wppm, more preferably below 10 wppm, most preferably about 1 wppm and less permits flux maintenance over the course of the pervaporation process.

THE PRESENT INVENTION

Figure 1:
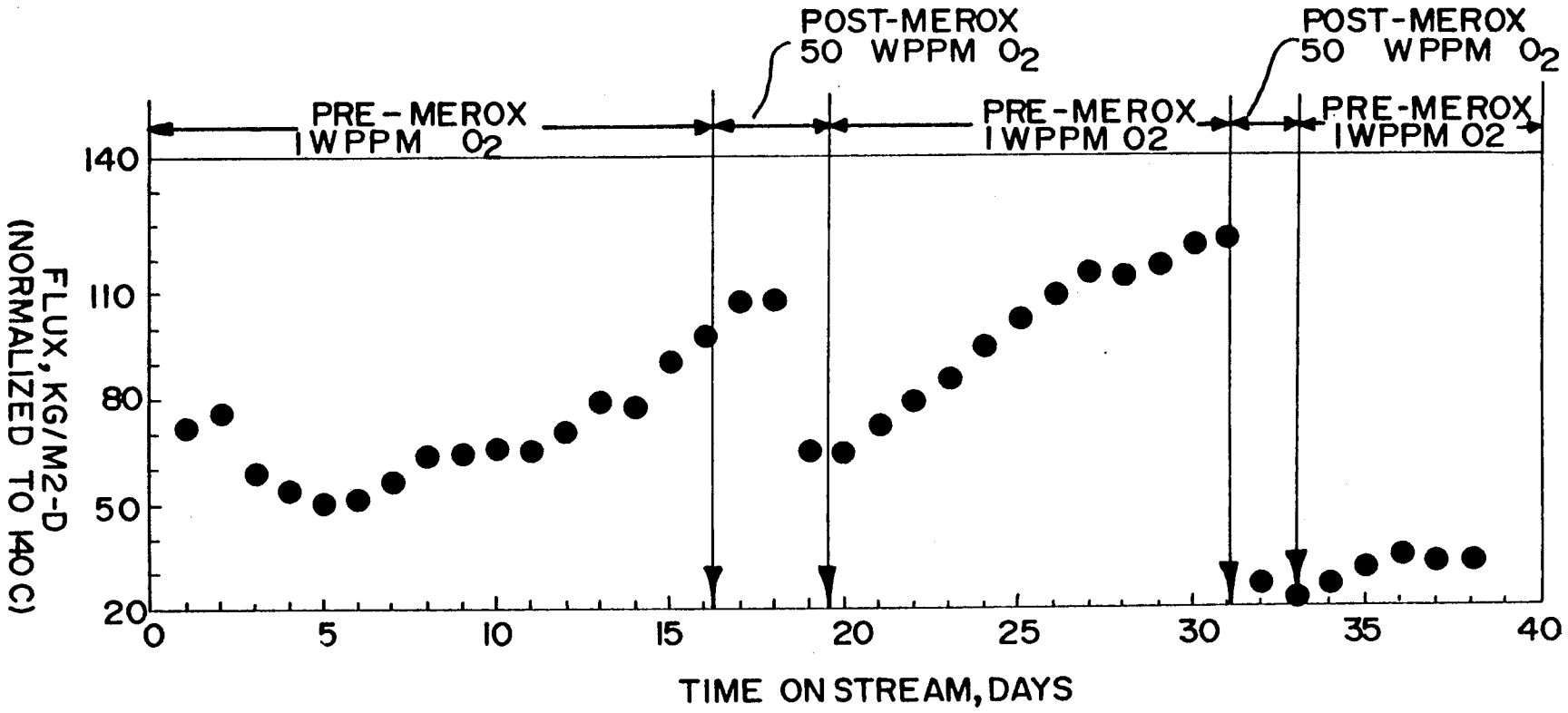
FIG. 1 shows the flux performance of membrane pervaporation of HCN samples both with low oxygen content and high oxygen content.

In the separation of aromatic hydrocarbons from feeds constituting mixtures of aromatic hydrocarbons and non-aromatic hydrocarbons wherein the aromatic hydrocarbon in a feed mixture is selectively permeated through a membrane under pervaporation conditions the improvement comprising maintaining the flux of the aromatic separation process by controlling the oxygen content level in the hydrocarbon feed so that the oxygen content is kept at or reduced to or below about 50 wppm, preferably below about 30 wppm, more preferably below about 10 wppm, most preferably about 1 wppm and less. The oxygen content can be controlled by insuring that feed which already possesses a low oxygen content is isolated from air or oxygen containing atmospheres and thus does not adsorb any oxygen. This can be accomplished by storing such feeds prior to membrane separation under an inert atmosphere such as nitrogen. Alternatively, such low oxygen content feeds can have oxygen scavengers or inhibitors added to them to negate any negative influence on flux should the feed be exposed to air or oxygen containing atmospheres.

Alternatively, feeds which already possess high concentrations of oxygen (in excess of about 50 wppm), can be distilled or subjected to nitrogen or fuel gas purging or can have oxygen scavengers or inhibitors added to them prior to or during the membrane separation process so as to inhibit the detrimental effect the presence of oxygen has on the flux of the separation process. The oxygen content of the feed is determined and an effective amount of the scavenger or inhibitor is added. Excessive scavenger or inhibitor addition should be avoided because the long term effect of such scavengers or inhibitors on the membranes is not known especially in those instances when the membrane itself possesses reactive oxygen sites, e.g., hydroxyl, carboxyl or reactive ether or ester sites. Oxygen scavengers or inhibitors are selected from the group consisting of hindered phenols hindered amines, and mixtures thereof.

The hydrocarbon feed which is subjected to the control of oxygen content is any cracked feed including by way of example light cat naphtha (LCN), intermediate cat naphtha (ICN), heavy cat naphtha (HCN), jet fuel, diesel fuel, coker gas oil, in general, cracked stocks boiling in the range from about 65° to 1050° F.

Large incentives have been identified in separating the aromatics and aliphatics from HCN stream. HCN is normally the 150°-220° C. distillation cut from the product stream of a catalytic cracker. Typically HCN contains from 50-70 vol % aromatics, 5-30 vol % olefins and the balance aliphatics. Since HCN contains both aromatic and aliphatic hydrocarbons its octane is below the pool specification (approximately 85 to 89 RON) while the cetane is extremely low (approximately 20).

A membrane process which separates HCN into a high octane aromatic-rich and high cetane aliphatic-rich stream with high selectivity and high flux is highly desirable. The aromatic-rich stream would make an excellent mogas blending stock, especially in a low or zero-lead environment. The aliphatic-rich stream, on the other hand, would be an excellent diesel or jet fuel blending stock.

The separation of aromatics from mixtures, however, can be applied to a wide variety of streams in the petrochemical industry alone. In all cases the selective removal of aromatics will produce higher quality products. For example, the removal of aromatics from a jet fuel stream will reduce the smoke point while the dearomatization of a diesel stream will increase its cetane.

In pervaporation, which is run at elevated temperatures which can be in the range of 75° to 300° C., the permeate is removed by a vacuum while in perstraction which is run at lower temperatures than pervaporation a sweep material is used. Pervaporation operates at higher membrane temperatures than perstraction in order to reduce the vacuum requirements to within practical limits. The key to both processes is a membrane which can selectively permeate aromatics from mixtures.

In concentration driven processes, such as pervaporation and perstraction, the aromatic molecules in the feed selectively dissolve into the membrane film and diffuse through said film to the permeate side under the influence of a concentration gradient. The rate controlling step is normally the diffusion of the aromatic molecules across the film. The rate of diffusion follows Fick's law and is inversely proportional to the thickness of the film: the thinner the film, the higher the diffusion rate or permeate flux.

In order to commercialize any process it is absolutely necessary to produce the desired-quality permeate at sufficiently high permeation rates. Subsequently, almost all membrane separation processes strive to use membranes with as thin a film (active separation barrier) as possible. The high initial fluxes of thin membranes are important, but maintaining these high initial fluxes throughout the life of the membrane is equally important.

It is known from the literature that oxygen can initiate polymerization of olefins and diolefins. In refinery processes these polymer products often plug heat exchangers and fixed bed reactors, thus limiting their life. The effect of oxygen on a membrane process such as the aromatic separation from cracked stocks, however, is not taught in the literature.

Although it is known that oxygen can initiate polymerization of olefins and diolefins it has been observed that the presence of oxygen in a cracked feed constituting heavy cat naphtha at 140° C. did not produce any visible particulate matter or gums, materials which would be expected to adversely affect flux.

This is an especially surprising result in that in the absence of observable particulate or measurable gum one would expect there to be no loss of flux. However, this is not the case.

The presence of as little as 50 wppm oxygen in the cracked stock HCN has been found to produce a significant and dramatic flux fall off under pervaporation conditions.

Control of the oxygen content level on cracked feed to below about 50 wppm, preferably below about 30 wppm, more preferably below about 10 wppm, most preferably about 1 wppm or less is expected to result in the elimination of flux loss during the pervaporation removal of aromatic hydrocarbons from cracked feed.

For cracked feeds which already possess low oxygen level contents, insuring that such feeds possess low oxygen levels during the pervaporative removal of aromatics takes the form of preventing exposure of the cracked feed to atmospheres containing oxygen. Thus, exposure to air by storage in tankage blanketed in air is to be avoided. Alternatively oxygen scavengers or inhibitors can be added to the feed. If the feed stream is first subjected to deliberate oxygen injection steps should be taken to lower the oxygen content prior to membrane separation. The Merox process is an example of a process which deliberately injects oxygen into the hydrocarbon. The Merox process is a method for reducing the mercaptan content of the hydrocarbon by injecting $O_2$ into the stream in the presence of a caustic to convert the mercaptans into di sulfides. For cracked feeds which have high dissolved oxygen contents (in excess of about 50 wppm) the oxygen content can be lowered by distillation, or by nitrogen or fuel gas purging prior to membrane separation. The use of oxygen scavenger or inhibitors prior to or during the pervaporative aromatics separation process will also insure the retention of high flux during the pervaporation process. Oxygen scavenger or inhibitor materials include hindered phenols and hindered amines. Hindered phenols are known in the art and include 2,6-di tert butyl phenol 2,4,6-tri-tert-butyl-phenol, ortho-tert-butyl-phenol, 2,6-di-tert-butyl-α-di-methyl amino-p-cresol, 4,4'methylene bis(2,6-di-tert-butyl phenol). Similarly hindered amines are also known and include N,N-di-phenyl-p-phenylene diamine, N,N'-di-isopropyl-p-phenylenediamine, N,N'-di-sec-butyl p-phenylenediamine, N,N'-di-sec-butyl-o-phenylenediamine, and N,N'-bis-(1,4-dimethyl-pentyl)-p-phenylenediamine.

The oxygen scavengers inhibitors can be used in an amount ranging from 5 wppm up to 2 wt %.

Pervaporation is run at elevated temperatures with the feed being in either liquid or vapor form and relies on vacuum or sweep gas on the permeate side to evaporate or otherwise remove the permeate from the surface of the membrane and maintain the concentration gradient driving force which drives the separation process. The aromatic molecules present in the feed dissolve into the membrane film, migrate through said film and reemerge on the permeate side under the influence of a concentration gradient. The sweep liquid, along with aromatics contained therein, is passed to separation means, typically distillation means, however, if a sweep liquid of low enough molecular weight is used, such as liquefied propane or butane, the sweep liquid can be permitted to simply evaporate, the liquid aromatics being recovered and the gaseous propane or butane (for example) being recovered and reliquefied by application of pressure or lowering the temperature. Pervaporation separation of aromatics from saturates can be performed at a temperature of about 25° C. for the separation of benzene from hexane but for separation of heavier aromatic/saturate mixtures, such as heavy cat naphtha, higher temperatures of at least 80° C. and higher, preferably at least 100° C. and higher, more preferably 120° C. and higher (up to about 170° to 200° C. and higher) can be used, the maximum upper limit being that temperature at which the membrane is physically damaged. Vacuum on the order of 1–50 mm Hg is pulled on the permeate side. The vacuum stream containing the permeate is cooled to condense out the highly aromatic permeate. Condensation temperature should be below the dew point of the permeate at a given vacuum level.

The membrane itself may be in any convenient form utilizing any convenient module design. Thus, sheets of membrane material may be most conveniently used in spiral wound form or in the form of plate and frame permeation cell modules. A flat membrane sheet element configuration is disclosed and claimed in U.S. Ser. No. 528,311, (recently allowed). Tubes and hollow fibers of membranes may be used in bundled configurations with either the feed or the sweep liquid (or vacuum) in the internal space of the tube or fiber, the other environment obviously being on the other side of the membrane wall.

The present invention is demonstrated by the following non-limiting examples.

EXAMPLE 1

An anisotropic polyurea-urethane (PUU) membrane as disclosed in U.S. Pat. No. 4,879,044 was evaluated in a plant pervaporation test. The PUU membrane was housed in a spiral wound element and operated at 140° C. A 10 mbar vacuum was used to remove the permeate. Either a pre-merox HCN feed or a post-merox HCN could be fed to the test skid. FIG. 1 shows the performance of the PUU spiral wound element over a 38 day period. As clearly demonstrated, the PUU flux declines significantly when the post-merox feed is used. This was quite unexpected and an effort was launched to find the cause of this flux decline. The pre Merox feed was of low oxygen content (1 wppm) while the post-Merox feed was of high oxygen content (50 wppm).

EXAMPLE 2

To see if the presence of oxygen produced any identifiable changes in the feed at pervaporation conditions HCN samples were heated to 140° C. in both the presence and absence of added oxygen. It is seen that the presence of oxygen (saturation) in a sample of heavy cat naphtha at 140° C. does not appreciably elevate the amount of gum present in the heavy cat naphtha as compared to a sample heated to 140° C. which was not saturated with oxygen.

TABLE I

| HCN GUM LEVEL | | |
|---|---|---|
| Sample | HCN | NCN |
| Oxygen Saturated | No | Yes |
| Gum Measurement, Mg/100 ml | | |
| HCN - as is, unwashed | 12.2 | 9.7 |
| HCN - Heptane insoluble | 12.2 | 9.4 |

HCN was heat soaked at 140° C. for 5 minutes prior to gum test.

The results are deemed to be equivalent within the accuracy of the test. From this example it is seen that the presence of oxygen does not significantly affect the gum content of the HCN at a temperature of 140° C., which is representative of the temperature experienced under pervaporation. Thus, one would conclude that, in the absence of increased gum formation, there should be no noticeable difference in flux under pervaporation conditions for aromatics removal from HCN containing oxygen as compared to HCN having a very low oxygen content, that is, that the presence of oxygen should have no noticeable effect on membrane performance.

Quite unexpectedly, it has been discovered that, even without increased gum formation, the presence of oxygen in heavy cat naphtha adversely affects the flux under pervaporation conditions for aromatics removal from feeds represented by HCN (as demonstrated below).

EXAMPLE 3

A thin film composite PUU membrane on a teflon support was made as follows:

A solution containing a polyurea-urethane polymer is prepared as follows. Four point five six (4.56) grams (0.00228 moles) of polyethylene adipate (MW=2000), 2.66 grams (0.00532 moles) of 500 MW polyethylene adipate and 3.81 grams (0.0152 moles) of 4,4'diphenylmethane diisocyanate are added to a 250 ml flask equipped with a stirrer and drying tube. The temperature is raised to 90° C. and held for 2 hours with stirring to produce an isocyanate-end-capped prepolymer. Twenty grams of dimethylformamide is added to this prepolymer and the mixture is stirred until clear. One point five grams (0.0076 moles) of 4,4' diaminodiphenylmethane is dissolved in ten grams of dimethylformamide and then added as chain extender to the prepolymer solution. This mixture was then allowed to react at room temperature (approx. 22° C.) for 20 minutes. The viscosity of the solution was approximately 100 cps.

The polymer solution was then diluted to 5 wt % such that the solution contained a 60/40 wt % blend of dimethylformamide/acetone. The solution was allowed to stand for 7 days at room temperature. The viscosity of the aged solution was 35 cps. After this period of time one wt % Zonyl FSN (Dupont) fluorosurfactant was added to the aged solution. (Note: the fluorosurfactant could also be added prior to aging). A microporous teflon membrane (K-150 from Desalination Systems Inc.) with nominal 0.1 micron pores was wash-coated with the polymer solution. The coating was dried with a hot air gun immediately after the wash-coating was complete. This technique produced composite membranes with the polyurea/urethane dense layer varying between 3 to 4 microns in thickness. Thinner coatings could be obtained by lowering the polymer concentration in the solution while thicker coatings are attained at higher polymer concentrations.

This membrane was tested in the lab. The PUU membrane was housed in a flat circular cell and operated at 140° C. A 10 mbar vacuum was used to remove the permeate. The HCN was nitrogen purged before the run to ensure an oxygen-free feed.

Figure 2:
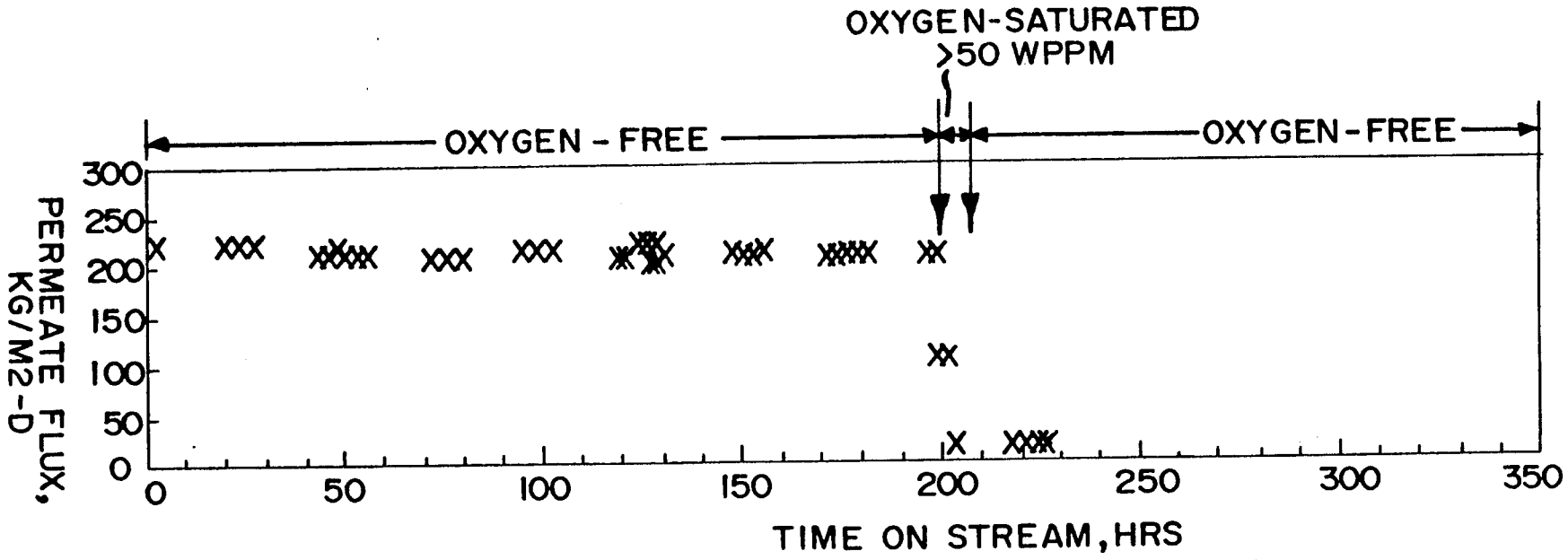
FIGS. 2 and 3 compare the flux performance of different membranes for the membrane pervaporation of HCN containing low oxygen concentration and after the saturation of HCN with oxygen.

As shown in FIG. 2 the flux performance is steady during the 200 hours of oxygen-free operation.

After 200 hours oxygen was injected (saturated, >50 wppm) into the feed for approximately 6 hours. The flux declined drastically with the oxygenated-HCN feed. The HCN was then nitrogen-purged to again ensure an oxygen-free feed. The flux, however, did not return to its original value. This example demonstrates that quite unexpectedly the presence of oxygen in the feed is the cause of the flux decline and that the effect of oxygen on the membrane performance is irreversible even in the absence of any increased particulate or gum formation as shown in Example 2.

Examples 1 and 3 demonstrate that the effect of oxygen is independent of the morphology of membrane. An anisotropic PUU was used in Example 1 while a thin film composite was used in Example 3. In both cases a drastic decline in the membrane flux was experienced with an oxygenated-HCN feed.

EXAMPLE 4

A thin film composite polyester-imide (PEI) membrane similar to those disclosed in U.S. Pat. Nos. 4,946,594, 4,990,275 and 4,944,880 was tested in the lab.

The PEI membrane tested was prepared as follows:

One point zero nine (1.09) grams (0.005 moles) of pulverized pyromellitic dianhydride (PMDA) was placed into a reactor. Five (5.0) grams (0.0025 moles) of predried 2000 MW polyethylene adipate (PEA) was added to the reactor. The PEA was dried at 60° C. and a vacuum of approximately 20" Hg. The prepolymer mixture was heated to 140° C. and stirred vigorously for approximately 1 hour to complete the endcapping of PEA with PMDA. The viscosity of the prepolymer increased during the endcapping reaction ultimately reaching the consistency of molasses.

The prepolymer temperature was reduced to 70° C. and then diluted with 40 grams of dimethylformamide (DMF). Zero point six seven (0.67) grams (0.0025 moles of 4,4'-methylene bis(o-chloroaniline) (MOCA) was added to 5.2 grams of DMF. The solution viscosity increased as the chain extension progressed. The solution was stirred and the viscosity was allowed to build up until the vortex created by the stirrer was reduced to approximately 50% of its original height. DMR was added incrementally to maintain the vortex level until 73.2 grams of DMF had been added. Thirty minutes was taken to complete the solvent addition. The solution was stirred at 70° C. for 2 hours then cooled to room temperature.

The polymer solution prepared above was cast on 0.2u pore teflon and allowed to dry overnight in $N_2$ at room temperature. The membrane was further dried at 120° C. for approximately another 18 hours. The membrane was then placed into a curing oven. The oven was heated to 260° C. (approximately 40 min) and then held at 260° C. for 5 min and finally allowed to cool down close to room temperature (approximately 4 hours).

Figure 3:
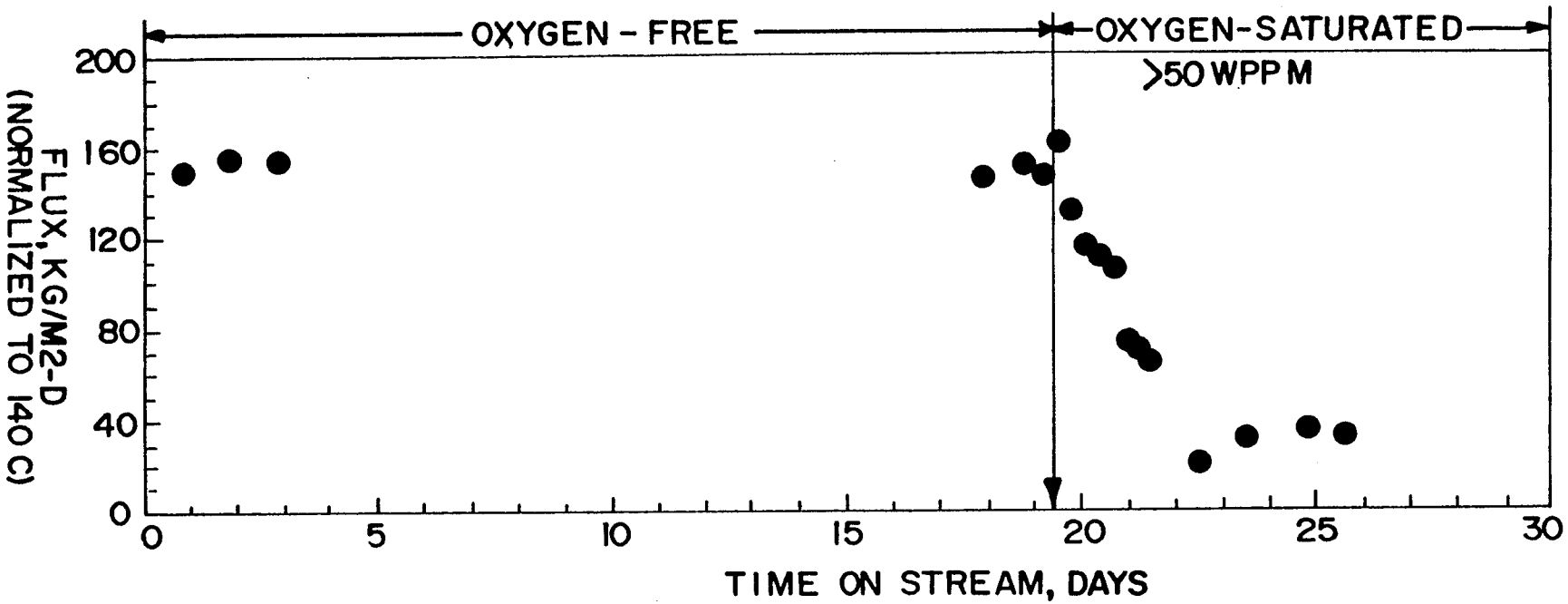

The PEI membrane was housed in a flat circular cell and operated at 140° C. A 10 mbar vacuum was used to remove the permeate. The HCN was nitrogen purged before the run to ensure an oxygen-free feed. After 19 hours of operation oxygen was injected (saturated) in the feed for 7 hours. The flux declined significantly with the oxygenated-HCN feed. FIG. 3.

Examples 3 and 4 demonstrate that the effect of oxygen is independent of the type of membrane. A drastic decline in flux was experienced with oxygenated-HCN using both a PUU and PEI membranes.

EXAMPLE 5

Figure 4:
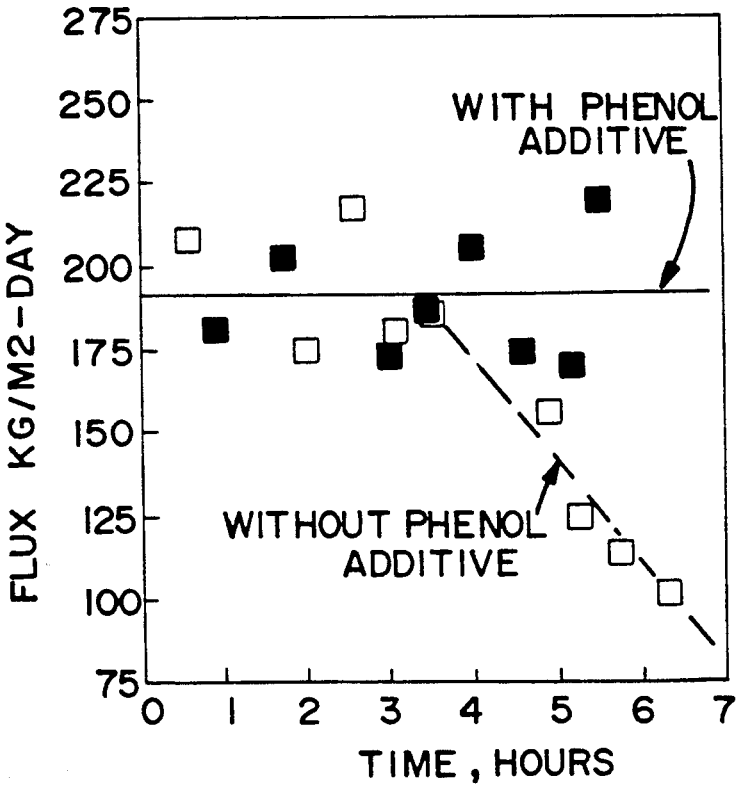
FIG. 4 compares the flux performance of membrane pervaporation of HCN containing high oxygen concentration both with and without the addition of hindered phenol oxygen inhibitor.

A pervaporation run was made first with PEI in the absence of hindered phenol at 140° C. and 10 mbars permeate pressure. For the first two hours of the run, the heavy cat naphtha was maintained under nitrogen blanket. As can be seen from FIG. 4, the initial flux was 192 kg/m$^2$-day while the selectivity as determined by the delta RON (research octane number) between the permeate and the feed was 11.8.

Figure 5:
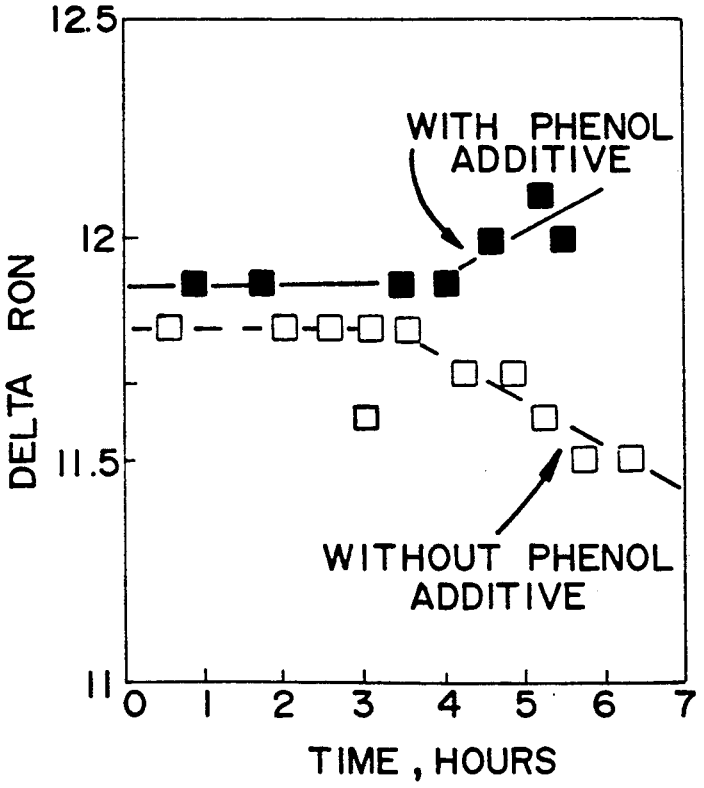
FIG. 5 compares the effect on delta RON of the membrane pervaporation of HCN containing high oxygen concentrations both with and without the addition of hindered phenol oxygen inhibitor.

In the next two hours, oxygen was bubbled into the feed and the PEI membrane lost as much as 40–50% of its initial flux. The delta RON between the feed and the permeate also dropped slightly, from 11.8 to 11.5 (see FIG. 5).

EXAMPLE 6

A run was made under nominally identical conditions to those used in Example 5 except that 1 wt % 2,6 di-tert butylphenol was added to the feed. As can be seen from FIG. 4, the PEI membrane maintained 100% of its initial flux in the presence of hindered phenol. In fact, the flux at the end of the run was higher than the initial flux (220 vs 193 kg/m$^2$-day). Another potential benefit of hindered phenol is that the selectivity was also improved slightly, from 11.9 to 12.0 (see FIG. 5).

Although data shown are for 2,6 di-tert butylphenol, it can be expected that other hindered phenols would also be effective in stabilizing pervaporation membrane performance in the presence of oxygen. In addition to heavy cat naphtha, it is also expected that hindered phenols would also be effective as oxygen inhibitors in pervaporation of other cracked hydrocarbon streams such as diesel.

What is claimed is:

1. A method for maintaining flux in a pervaporative separation process for separating aromatics from hydrocarbon feed streams comprising mixtures of aromatics and non-aromatics by selective permeation of aromatics through selective membranes, said method comprising maintaining in the feed which is subjected to pervaporative separation through selective membrane an oxygen concentration at a desired level of below about 50 wppm.

2. The method of claim 1 wherein the oxygen concentration on the feed is maintained at a desired level of below about 30 wppm.

3. The method of claim 2 wherein the oxygen concentration in the feed is maintained at a desired level of below about 10 wppm.

4. The method of claim 3 wherein the oxygen concentration in the feed is maintained at a desired level of about 1 wppm and less.

5. The method of claims 1, 2, 3 or 4 wherein the feed is any cracked stock boiling in the range of from about 65° F. to 1050° F.

6. The method of claims 1, 2, 3 or 4 wherein the oxygen content of the feed is maintained at or below the desired level by the step of isolating the feed which already possesses the desired oxygen content level, from air or oxygen containing atmospheres.

7. The method of claim 5 wherein the oxygen content of the feed is maintained at or below the desired level by the step of isolating the feed, which already possesses the desired oxygen content level, from air or oxygen containing atmospheres.

8. A method for maintaining flux in a pervaporative separation process for separating aromatics from hydrocarbon feed streams comprising mixtures of aromatics and non-aromatics by selective permeation of aromatics through selective membranes wherein said feed possesses an oxygen concentration in excess of about 50 wppm by the step of reducing the oxygen concentration in the feed subjected to pervaporative separation through a selective membrane to a desired level of below about 50 wppm.

9. The method of claim 8 wherein the oxygen concentration in the feed is reduced to a desired level of below about 30 wppm.

10. The method of claim 9 wherein the oxygen concentration in the feed is reduced to a desired level of below about 10 wppm.

11. The method of claim 10 wherein the oxygen concentration in the feed is reduced to a desired level of about 1 wppm and less.

12. The method of claims 8, 9, 10 or 11 wherein the feed is any cracked stock boiling in the range of from about 65° F. to 1050° F.

13. The method of claims 8, 9, 10 or 11 wherein the oxygen concentration in the feed is reduced to or below the desired level by distilling or nitrogen or fuel gas purging the feed prior to introducing the feed to the pervaporative separation process.

14. The method of claim 12 wherein the oxygen concentration in the feed is reduced to or below the desired level by distilling or nitrogen or fuel gas purging the feed prior to introducing the feed to the pervaporative separation process.

15. The method of claims 8, 9 10 or 11 wherein the oxygen concentration in the feed is reduced to or below the desired level by adding an effective amount of an oxygen scavenger or inhibitor to the feed prior to introducing the feed to the pervaporative separation process.

16. The method of claim 12 wherein the oxygen concentration in the feed is reduced to or below the desired level by adding an effective amount of oxygen scavenger or inhibitor to the feed prior to introducing the feed to the pervaporative separation process.

17. The method of claim 15 wherein the oxygen scavenger or inhibitor is selected from the group consisting of hindered phenols, hindered amines and mixtures thereof.

18. The method of claim 16 wherein the oxygen scavenger or inhibitor is selected from the group consisting of hindered phenols, hindered amines and mixtures thereof.

* * * * *